US010697416B2

(12) United States Patent
Matsuyama et al.

(10) Patent No.: US 10,697,416 B2
(45) Date of Patent: Jun. 30, 2020

(54) ENGINE GENERATOR

(71) Applicant: Honda Motor Co., Ltd., Tokyo (JP)

(72) Inventors: Wataru Matsuyama, Wako (JP); Kenji Shibata, Wako (JP); Tetsuya Matsuhisa, Wako (JP); Minoru Maedako, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 61 days.

(21) Appl. No.: 15/938,852

(22) Filed: Mar. 28, 2018

(65) Prior Publication Data

US 2018/0283340 A1 Oct. 4, 2018

(30) Foreign Application Priority Data

Mar. 30, 2017 (JP) ..... 2017-066552

(51) Int. Cl.
*F02N 11/00* (2006.01)
*F02N 11/04* (2006.01)
*F02N 11/08* (2006.01)

(52) U.S. Cl.
CPC ..... *F02N 11/04* (2013.01); *F02N 11/087* (2013.01); *F02N 2011/0874* (2013.01); *F02N 2011/0885* (2013.01); *F02N 2011/0896* (2013.01); *F02N 2200/022* (2013.01); *F02N 2200/042* (2013.01); *F02N 2300/104* (2013.01)

(58) Field of Classification Search
CPC ..... F02N 11/04; F02N 11/087; F02N 2011/0896; F02N 2200/022; F02N 2200/042
USPC .... 290/40 R, 40 C, 40 B, 31; 322/24, 28, 20
See application file for complete search history.

(56) References Cited

U.S. PATENT DOCUMENTS 3,378,755 A * 4/1968 Sawyer ..... H02J 7/1484 318/771
3,689,826 A * 9/1972 Cherry ..... H02J 7/1484 310/68 D
5,051,639 A * 9/1991 Satake ..... H02K 16/00 310/112
5,142,213 A * 8/1992 Stelter ..... H02P 1/32 318/771

(Continued)

FOREIGN PATENT DOCUMENTS

JP 2000316299 A 11/2000

*Primary Examiner* — Julio C. Gonzalez
(74) *Attorney, Agent, or Firm* — Duft & Bornsen, PC

(57) ABSTRACT

An engine generator, including an engine having a piston reciprocating inside a cylinder, a generator unit having a three-phase winding, driven by the engine to generate power and operating as an engine starter motor during engine starting, a power converter circuit connected to the generator unit, a battery supplying power to the generator unit through the power converter circuit during engine starting, an engine speed detection unit detecting an engine speed, a connection switching unit switching a connection configuration of the winding to one of a wye-connection and a delta-connection, and a connection switching control unit controlling the connection switching unit to switch the connection configuration to the wye-connection when the engine speed is lower than a predetermined engine speed, and to switch the connection configuration to the delta-connection when the engine speed is equal to or higher than the predetermined engine speed, during engine starting.

7 Claims, 6 Drawing Sheets

(56) References Cited

U.S. PATENT DOCUMENTS

| | | | | | |
|---|---|---|---|---|---|
| 5,675,222 | A * | 10/1997 | Fliege | H02P 1/32 | 318/139 |
| 5,760,567 | A * | 6/1998 | Nakamura | H02P 25/20 | 310/184 |
| 5,915,488 | A * | 6/1999 | Fliege | B60L 3/0007 | 180/65.22 |
| 6,154,003 | A * | 11/2000 | Satake | H02K 16/00 | 318/771 |
| 7,352,076 | B1 * | 4/2008 | Gabrys | F03D 3/005 | 290/44 |
| 2004/0174018 | A1 * | 9/2004 | Itoh | B60W 10/26 | 290/40 C |
| 2004/0217723 | A1 * | 11/2004 | Cai | F02N 11/04 | 318/268 |
| 2007/0137908 | A1 * | 6/2007 | Fujiwara | B60K 6/26 | 180/65.22 |
| 2010/0156330 | A1 * | 6/2010 | Inoue | B60L 15/025 | 318/400.02 |
| 2017/0272015 | A1 * | 9/2017 | Klodowski | H02P 9/008 | |

* cited by examiner

ENGINE GENERATOR

CROSS-REFERENCE TO RELATED APPLICATION

This application is based upon and claims the benefit of priority from Japanese Patent Application No. 2017-066552 filed on Mar. 30, 2017, the content of which is incorporated herein by reference.

BACKGROUND OF THE INVENTION

Field of the Invention

This invention relates to an engine generator which can be operated as an engine starter motor for starting a piston engine.

Description of the Related Art

In a generator of this type, when the generator is itself used as a motor for engine starting, the generator needs to develop large torque for crankshaft rotation, particularly large torque exceeding breakaway torque during first crankshaft revolution. Regarding this issue, Japanese Unexamined Patent Publication No. 2000-316299 (JP2000-316299A), for example, teaches a generator adapted to increase torque during engine starting by connecting a capacitor charged during engine operation between a battery and a motor driver in series with the battery and superposing voltage charged in the capacitor on battery voltage to increase motor drive voltage during engine starting.

The generator according to JP2000-316299A is configured to pass large current through a stator winding via the motor driver by using the capacitor to boost drive voltage. This increases cost because the motor driver is required to employ costly high current capacity devices.

SUMMARY OF THE INVENTION

An aspect of the present invention is an engine generator, including: an engine having a piston configured to reciprocate inside a cylinder; a generator unit having a three-phase winding and configured to be driven by the engine to generate electric power and configured to be able to operate as an engine starter motor during engine starting; a power converter circuit electrically connected to the generator unit; a battery configured to supply electric power to the generator unit through the power converter circuit during engine starting; an engine speed detection unit configured to detect an engine speed of the engine; a connection switching unit configured to switch a connection configuration of the winding to one of a wye-connection and a delta-connection; and a connection switching control unit configured to control the connection switching unit to switch the connection configuration to the wye-connection when the engine speed detected by the engine speed detection unit is lower than a predetermined engine speed, and to switch the connection configuration to the delta-connection when the engine speed detected by the engine speed detection unit is equal to or higher than the predetermined engine speed, during engine starting.

BRIEF DESCRIPTION OF THE DRAWINGS

The objects, features, and advantages of the present invention will become clearer from the following description of embodiments in relation to the attached drawings, in which.

DETAILED DESCRIPTION OF THE INVENTION

Figure 1:
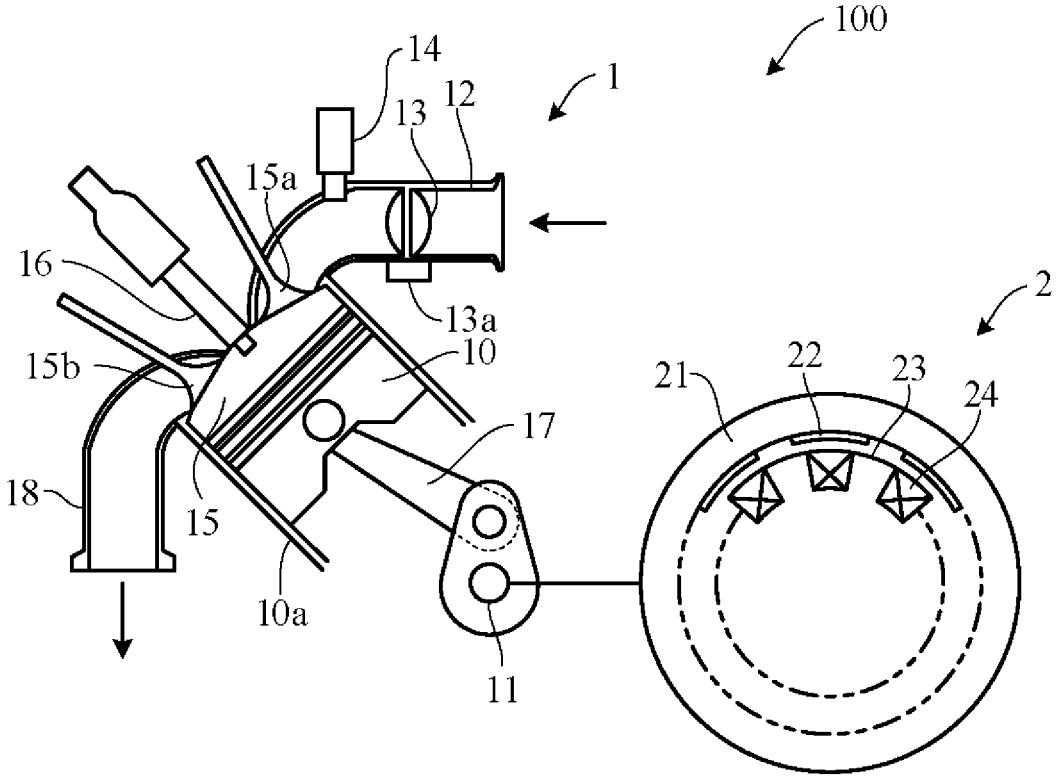
FIG. 1 is a diagram showing essential components of a general-purpose engine and a generator unit constituting an engine generator according to an embodiment of the present invention.

An embodiment of the present invention is explained with reference to FIGS. 1 to 6 in the following. An engine generator according to the embodiment of the present invention is a portable or mobile generator of weight and size a user can carry by hand. FIG. 1 is a diagram showing essential components of a general-purpose engine 1 and a generator unit (generator main unit) 2 constituting an engine generator 100 according to the embodiment of the present invention. The engine 1 is, for example, a spark ignition, air cooled, gasoline fueled engine and has a piston 10 that reciprocates inside a cylinder 10*a* and a crankshaft (output shaft) 11 that rotates synchronously with the piston 10.

As shown in FIG. 1, an air intake pipe 12 of the engine 1 is equipped with a throttle valve 13 whose opening is adjusted by a throttle motor 13*a*, and an injector 14 for producing an air-fuel mixture by injecting fuel into air metered by the throttle valve 13. Air-fuel mixture sucked into a combustion chamber 15 through an intake valve 15*a* is ignited by a spark plug 16 and combusted (explosively) to reciprocally drive a piston 10. Reciprocal motion of the piston 10 is transmitted through a connecting rod 17 to rotate a crankshaft 11. Air-fuel mixture combusted in the combustion chamber 15 is discharged through an exhaust valve 15*b* and an exhaust pipe 18.

The crankshaft 11 is connected with the generator unit 2. The generator unit 2 is a multipolar alternator driven by the engine 1 to generate AC power. It comprises a rotor 21 connected to and rotated integrally with the crankshaft 11 and a stator 23 arranged concentric with the rotor 21 and inside in the radial direction thereof. The rotor 21 is provided with permanent magnets 22. The stator 23 is provided with UVW windings 24 arranged at phase angle differences of 120 degree.

When the rotor 21 of the generator unit 2 is rotationally driven by power of the engine 1 transmitted through the crankshaft 11, U-phase, V-phase and W-phase AC power is output from the winding 24. In other words, the generator unit 2 generates power. An inverter circuit electrically connected to the generator unit 2 converts three-phase AC output by the generator unit 2 to AC power of a predetermined frequency.

Figure 2:
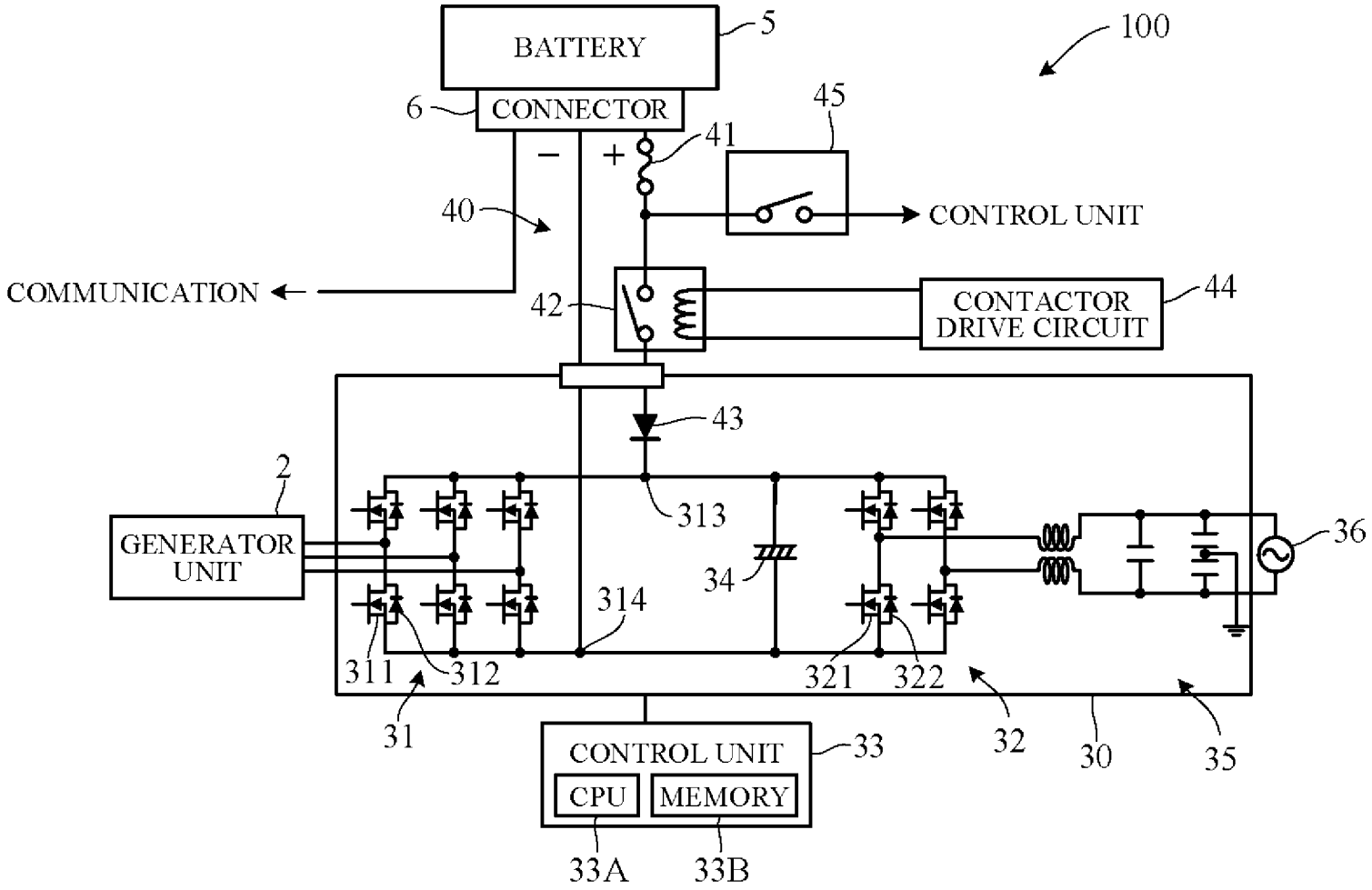
FIG. 2 is an electrical circuit diagram showing an overall configuration of the engine generator according to the embodiment of the present invention.

FIG. 2 is an electrical circuit diagram showing an overall configuration of the engine generator 100. As shown in FIG. 2, the inverter circuit 30 comprises a power converter circuit 31 for rectifying three-phase AC current output by the generator unit 2, an inverter 32 for converting DC current output from the power converter circuit 31 to a predetermined three-phase AC current, and a control unit 33 for controlling the power converter circuit 31 and the inverter 32. The power converter circuit 31 can also convert DC current supplied from a battery 5 to three-phase AC current and output to the generator unit 2. Therefore, the generator unit 2 functions not only as a generator for generating power, but as a starter for starting the engine 1.

The control unit 33 is constituted as a microcomputer including an arithmetic processing unit comprising a CPU 33A and a memory 33B such as ROM, RAM and other peripheral circuits and the like.

The power converter circuit 31 is configured as a bridge circuit and comprises three pairs of (a total of six) semiconductor switching elements 311 associated one with each of the U-phase, V-phase and W-phase windings of the generator unit 2. The switching elements 311 are constituted using transistors such as MOSFETs or IGBTs, for example, and a diode (e.g., parasitic diode) 312 is connected in parallel with each switching element 311. A gate of each switching element 311 is driven by a control signal output from the control unit 33, and ON-OFF switching of the switching elements 311 is controlled by the control unit 33. For example, when the generator unit 2 operates as a generator, the switching elements 311 are turned OFF, so that three-phase AC is rectified by the diodes 312. The rectified current is smoothed by a capacitor 34 and sent to the inverter 32.

The inverter 32 has two pairs of (a total of four) semiconductor switching elements 321 configured as an H-bridge circuit. The switching elements 321 are constituted using transistors such as MOSFETs or IGBTs, for example, and a diode (e.g., parasitic diode) 322 is connected in parallel with each switching element 321. A gate of the switching element 321 is driven by a control signal output from the control unit 33, ON-OFF switching of the switching elements 321 is controlled by the control unit 33, and DC current is converted to a single-phase AC. The single-phase AC generated by the inverter 32 is sinusoidally modulated by passage through a filter circuit 35 including reactor and capacitor and output to loads 36.

The battery 5 is electrically connected to the inverter circuit 30 through a power supply circuit 40. The power supply circuit 40 is provided so as to connect the battery 5 through a connector 6 to the power converter circuit 31 and the capacitor 34, i.e., to positive side and negative side output terminals 313 and 314 of the power converter circuit 31. More specifically, a positive side terminal of the battery 5 is connected to the positive side output terminal 313 through a fuse 41, a contactor 42 and a diode 43, and a negative side terminal thereof is connected to the minus side output terminal 314.

The contactor 42 includes a switch for connecting (ON) and disconnecting (OFF) the battery 5 to and from the inverter circuit 30, and its ON-OFF operation is controlled by a contactor drive circuit 44. A battery switch 45 is connected between the fuse 41 and the contactor 42, and power is supplied to the control unit 33 by turning the battery switch 45 ON. This causes the contactor drive circuit 44 to turn the contactor 42 ON. When the battery switch 45 is turned OFF, the contactor drive circuit 44 turns the contactor 42 OFF. In other words, the contactor 42 is turned ON and OFF conjointly with ON-OFF operation of the battery switch 45.

When the engine 1 is to be started by power from the battery 5, the user turns the battery switch 45 ON. This turns the contactor 42 ON, and power of the battery 5 is supplied to the power converter circuit 31. At this time, the control unit 33 determines whether the battery switch 45 is ON, and when it determines the battery switch 45 to be ON, it ON-OFF controls the switching elements 311 of the power converter circuit 31 to convert DC power to AC power. The resulting AC power is supplied to the generator unit 2, so that a revolving magnetic field is produced in a stator winding 24 (FIG. 1) and a rotor 21 of the generator unit 2 rotates. As a result, a crankshaft 11 is rotated and the engine 1 can be started by cranking.

When the battery switch 45 is turned OFF after starting of the engine 1 is completed, the contactor 42 turns OFF and cuts off supply of power from the battery 5 to the inverter circuit 30. After this, the rotor 21 of the generator unit 2 is rotationally driven by the engine 1 and the generator unit 2 generates power. Some of the power generated by the generator unit 2 is supplied to the control unit 33 and other components. A communication line is connected to the connector 6, and internal temperature, charge state and other battery 5 data are transmitted through this communication line to the control unit 33.

Figure 3:
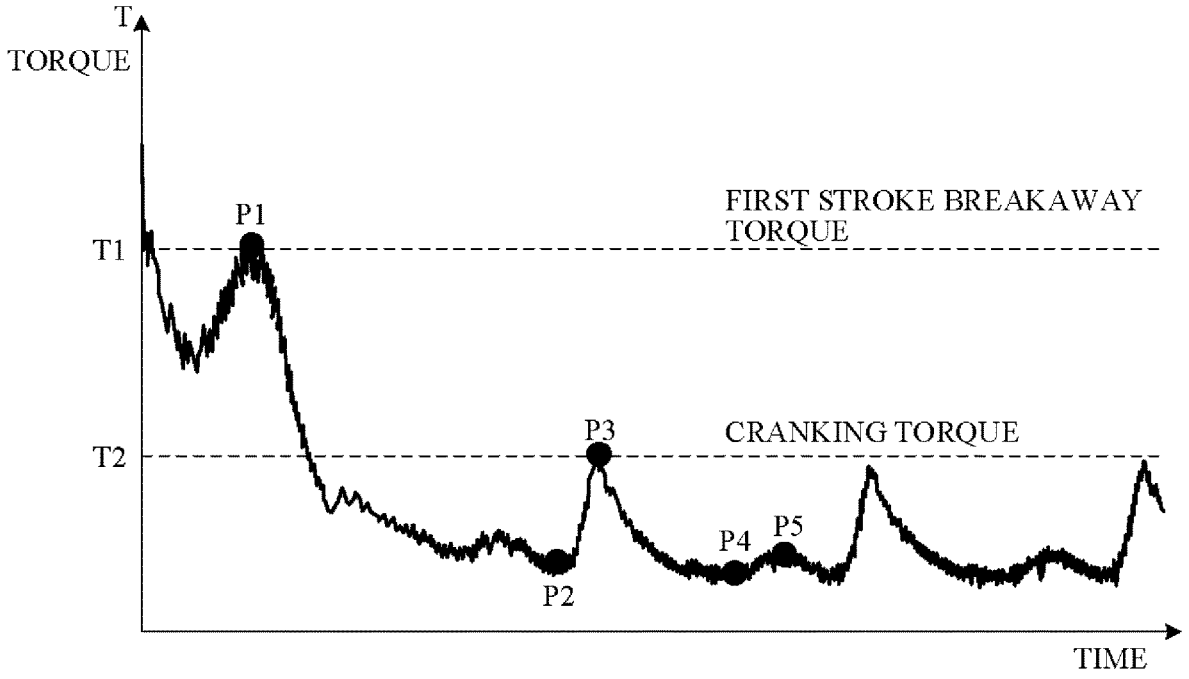
FIG. 3 is a diagram showing a temporal change in torque required when starting the engine generator according to the embodiment of the present invention.

A concern in this regard is that when the generator unit 2 is used as a starter motor that starts the engine 1 by rotating the crankshaft 11 as touched on above, greatest torque is needed to carry the piston 10 beyond upper dead center in first compression stroke. FIG. 3 is a diagram showing an example of change in required torque in the course of engine starting. Points P1 to P5 in the diagram indicate torque in first compression stroke, intake stroke, second compression stroke, combustion stroke, and exhaust stroke, respectively.

As seen in FIG. 3, torque required during engine starting is greatest when the piston 10 is cranked beyond upper dead center in first compression stroke. In the following description, torque at this time is called first stroke breakaway torque T1, and torque for increasing engine speed to cranking speed enabling engine starting is called cranking torque T2. Cranking torque T2 is less than first stroke breakaway torque T1.

Although the generator unit 2 operating as a starter motor thus needs to develop great first stroke breakaway torque T1 during engine starting, an attempt to meet this need by, for example, increasing battery voltage so as to pass large current through the winding 24 proves costly because the power converter circuit 31 between the battery 5 and the winding 24 has to be equipped with expensive high current capacity devices. In the present embodiment, therefore, the engine-generator 100 is configured as described in the following so as to enable the generator unit 2 to produce adequate torque during engine starting, while minimizing cost increase.

Figure 4:
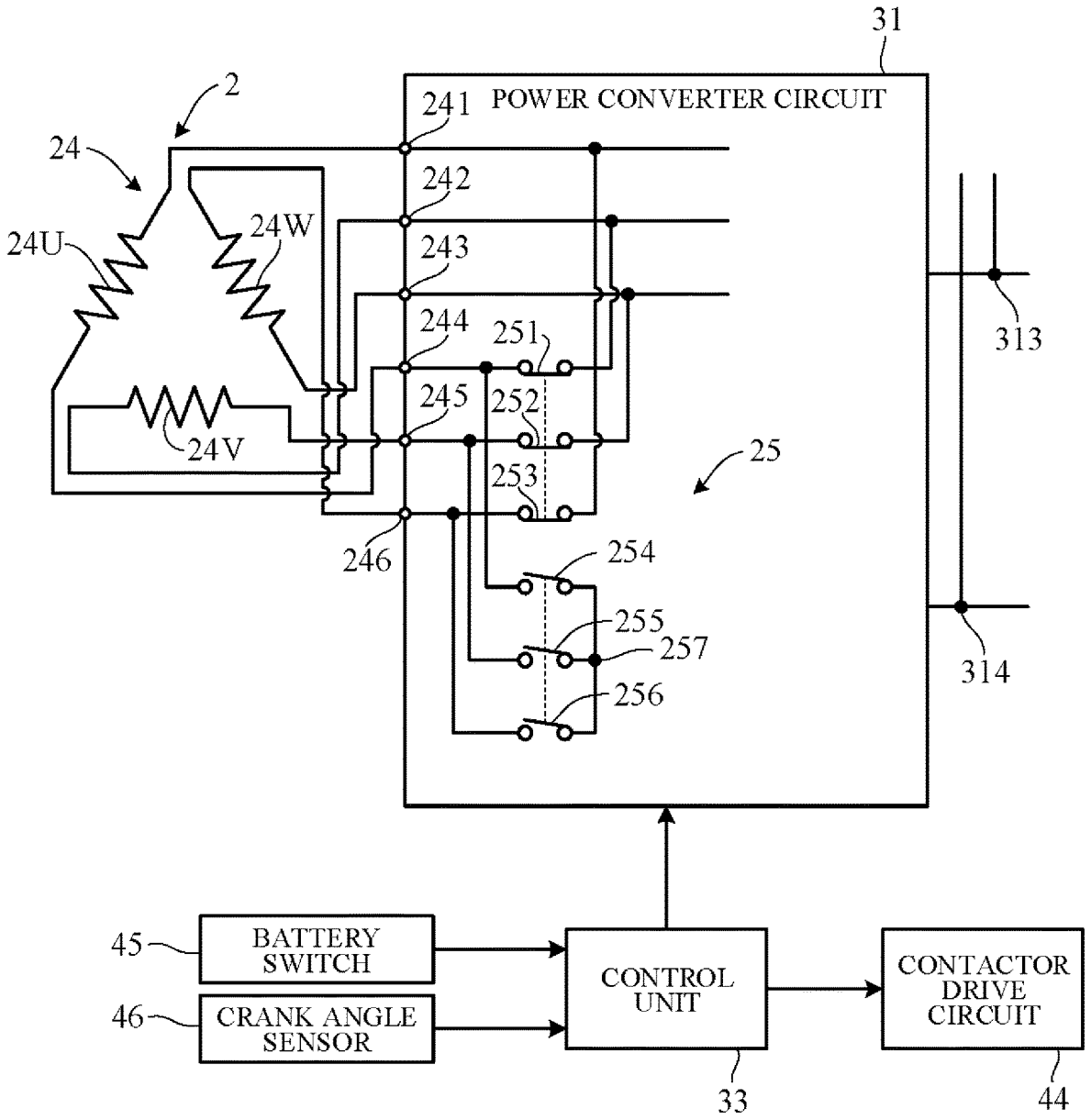
FIG. 4 is an electrical circuit diagram showing essential components of the engine generator according to the embodiment of the present invention.

FIG. 4 is an electrical circuit diagram showing essential components of the engine-generator 100 according to the embodiment of the present invention. As shown in FIG. 4, the winding 24 of the generator unit 2 includes a U-phase winding 24U, a V-phase winding 24V and a W-phase winding 24W. One end terminals (first terminal to third terminal) 241 to 243 of the windings 24U, 24V and 24W are connected to the switching elements 311 and the diodes 312 of the power converter circuit 31 of FIG. 2. Other end terminals (fourth terminal to sixth terminal) 244 to 246 of the windings 24U, 24V and 24W are connected to a switching circuit 25 of FIG. 4.

The switching circuit 25 is provided between the generator unit 2 and the power converter circuit 31 and is implemented on an inverter unit forming the inverter circuit 30. More specifically, the switching circuit 25 comprises a switch (first switch) 251 whose one end is connected to the terminal 244 and other end is connected to the terminal 242, a switch (second switch) 252 whose one end is connected to the terminal 245 and other end is connected to the terminal 243, a switch (third switch) 253 whose one end is connected to the terminal 246 and other end is connected to the terminal 241, and switches (fourth switch to sixth switch) 254 to 256 whose one ends are connected to the terminals 244 to 246, respectively, and other ends are connected together through a neutral point 257. The switches 251 to 256 are, for example, constituted as relay switches that are opened and closed (turned ON and OFF) by energizing and de-energizing coils.

The switches 251 to 256 are opened and closed, i.e., their coils are energized and de-energized, by control signals from the control unit 33. Where the switches 251 to 253 are defined as a first switch group and the switches 254 to 256 as a second switch group, the control unit 33 outputs control signals to simultaneously turn ON the switches 251 to 253 of the first switch group and simultaneously turn OFF the switches 254 to 256 of the second switch group, or to simultaneously turn OFF the switches 251 to 253 of the first switch group and simultaneously turn ON the switches 254 to 256 of the second switch group.

When the first switch group switches 251 to 253 turn OFF and the second switch group switches 254 to 256 turn ON, the connection configuration of the winding 24 switches to wye-connection. When the first switch group switches 251 to 253 turn ON and the second switch group switches 254 to 256 turn OFF, the connection configuration of the winding 24 switches to delta-connection.

The control unit 33 is connected with a battery switch 45, and a crankangle sensor 46 of electromagnetic pickup type or optical type for detecting rotation angle of the crankshaft 11 and the engine speed. The control unit 33 performs predetermined processing at the time of engine starting using signals from the battery switch 45 and the crankangle sensor 46. As a result of this processing, control signals are output to the contactor drive circuit 44 (FIG. 2) for controlling ON-OFF switching of the contactor 42 and are also output for controlling ON-OFF switching of the switches 251 to 256 of the switching circuit 25.

Figure 5:
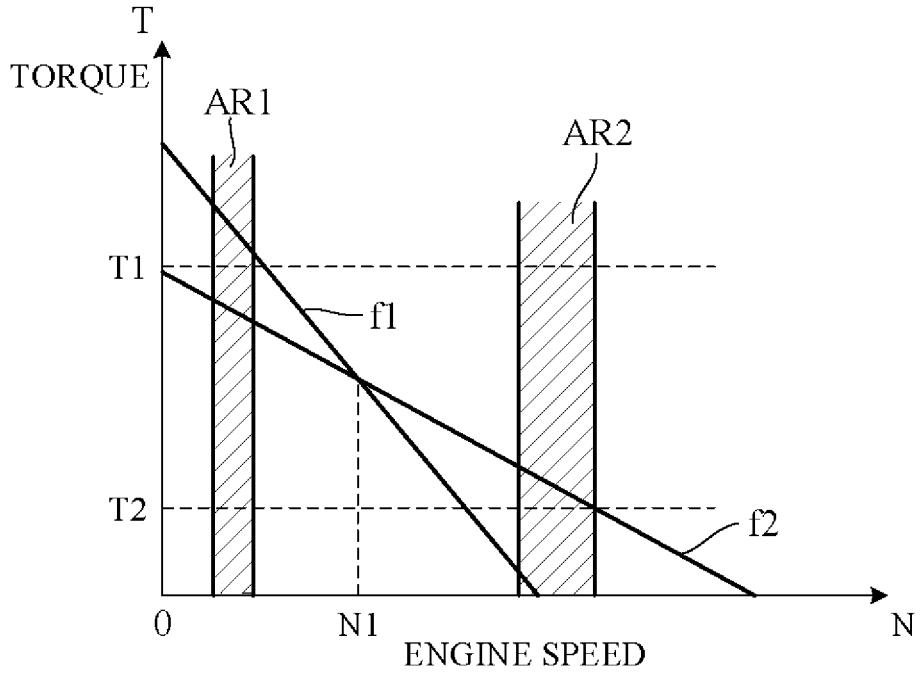
FIG. 5 is a diagram showing relationship between an engine speed and a torque when a connection configuration is a wye-connection and a delta-connection.

FIG. 5 is a diagram showing line current passing through the terminals 241 to 243 when connection configuration is wye-connection and delta-connection, i.e., relation between engine speed N and torque (motor torque) T output by the generator unit 2 when line currents passing through devices of the power converter circuit 31 are assumed equal. In this figure, characteristic curve f1 represents characteristics in wye-connection and characteristic curve f2 represents characteristics in delta-connection.

At the same line current in wye-connection and delta-connection, wye-connection line voltage is greater than delta-connection line voltage, so, as shown in FIG. 5, output torque T immediately after engine starting is about 1.5 times greater in wye-connection (characteristic curve f1) than in delta-connection (characteristic curve f2). On the other hand, output torque T gradually decreases with increasing engine speed N in both wye-connection and delta-connection owing to the effect of counter-electromotive force. Since no-load speed occurs at the point where battery voltage and counter-electromotive voltage come into balance, no-load speed of the engine 1 is about 1.5 times greater in delta-connection (characteristic curve f2) than in wye-connection (characteristic curve f1). Since characteristic curve f1 and characteristic curve f2 intersect at engine speed N1, torque magnitude relation between the characteristic curves inverts at this engine speed N1.

It follows from the foregoing that first stroke breakaway torque T1 (FIG. 3) required by the engine 1 can be easily produced by switching to wye-connection immediately after engine starting is commenced. Further, cranking torque T2 (FIG. 3) for enabling the engine 1 to achieve complete combustion can be easily produced by switching to delta-connection in a region of high engine speed. Region AR1 in FIG. 5 corresponds to a region of engine speed occurring in first compression stroke, and region AR2 corresponds to a region of engine speed enabling the engine 1 to achieve complete combustion.

Figure 6:
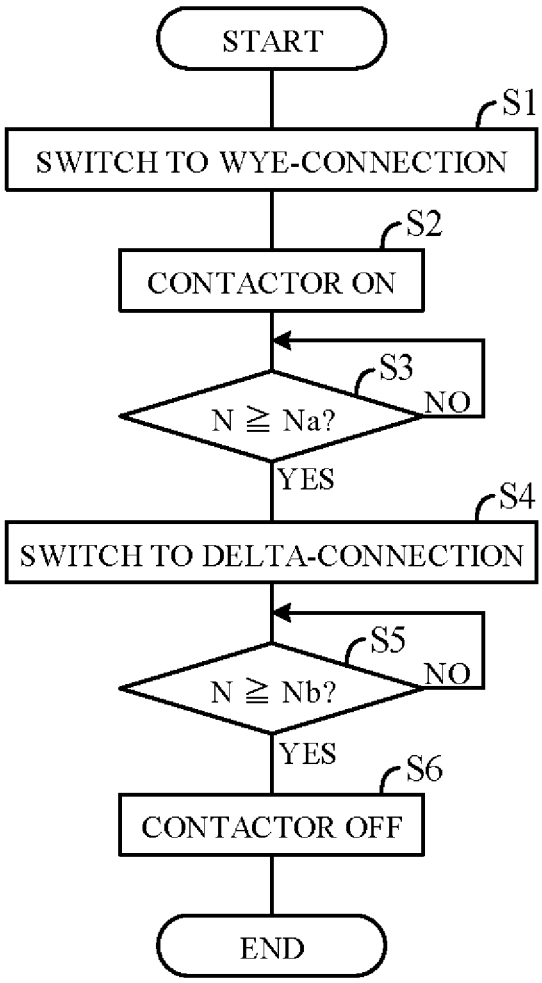
FIG. 6 is a flowchart showing an example of processing performed by a control unit of FIG. 4.

FIG. 6 is a flowchart showing an example of processing performed by the control unit 33 (CPU 33A) in accordance with a program loaded in the memory 33B in advance. The processing represented by this flowchart, is started when the battery switch 45 is turned on and power is supplied to the control unit 33.

First, in S1 (S: processing Step), the switches 251 to 253 of the first switch group are turned OFF and the switches 254 to 256 of the second switch group are turned ON, thereby putting connection configuration of the winding 24 in wye-connection. Next, in S2, a control signal is output to the contactor drive circuit 44 to turn the switch of the contactor 42 ON. At this time, the control unit 33 ON-OFF controls the switching elements 311 of the power converter circuit 31, whereby power of the battery 5 is converted to AC power by the power converter circuit 31 and supplied to the winding 24. Since winding configuration is wye-connection, the generator unit 2 can output high torque exceeding first stroke breakaway torque T1 so that the crankshaft 11 can be easily rotated from stopped state.

Next, in S3, whether engine speed N detected by the crankangle sensor 46 is predetermined speed Na or greater is determined. Since this is for determining whether first compression stroke has been completed, predetermined speed Na is set within engine speed region AR1 in FIG. 5, for example. Alternatively, predetermined speed Na can be set to engine speed N1 in FIG. 5. S3 is repeated until the determination result becomes YES, whereafter the program goes to S4.

In S4, the switches 251 to 253 of the first switch group are turned ON and the switches 254 to 256 of the second switch group are turned OFF, thereby switching connection configuration of the winding 24 to delta-connection. Since this enables output of high-speed side torque, cranking speed of the engine 1 can be easily increased to a speed capable of achieving complete combustion.

Next, in S5, whether engine speed N detected by the crankangle sensor 46 is predetermined speed Nb or greater is determined. Since this is for determining whether engine speed N has risen to a speed enabling complete combustion, predetermined engine speed Nb is set greater than predetermined speed Na, to within engine speed region AR2 in FIG. 5, for example. S5 is repeated until the determination result becomes YES, whereafter the program goes to S6. In S6, a control signal is output to the contactor drive circuit 44 to turn the switch of the contactor 42 OFF. This cuts off supply of power from the battery 5.

The present embodiment can achieve advantages and effects such as the following.

(1) The engine-generator 100 includes the engine 1 including the piston 10 that reciprocates inside the cylinder 10*a*, the generator unit 2 having the three-phase winding 24 and driven by the engine 1 to generate electric power and also capable of operating as an engine starter motor during engine starting, the power converter circuit 31 electrically connected to the generator unit 2, the battery 5 that supplies power to the generator unit 2 through the power converter circuit 31 during engine starting, the crankangle sensor 46 for detecting rotational speed of the engine 1, the switching circuit 25 for switching connection configuration of the winding 24 to one or the other of wye-connection and delta-connection, and the control unit 33 that during engine starting ON-OFF controls the switching circuit 25 to switch connection configuration of the winding 24 to wye-connection until engine speed N detected by the crankangle sensor 46 reaches predetermined speed Na (e.g., N1 in FIG. 5) and switch connection configuration of the winding 24 to delta-connection when engine speed N detected by the crankangle sensor 46 exceeds predetermined speed Na (FIGS. 1, 2 and 4; S1 and S4).

Owing to this configuration, starting of the engine 1 is commenced in a state with connection configuration switched to wye-connection, so that high torque exceeding first stroke breakaway torque T1 can be developed without passing large current to the power converter circuit 31. Cost increase of the engine-generator 100 can therefore be minimized because the power converter circuit 31 need not use costly devices. Moreover, when engine speed (cranking speed) N exceeds predetermined speed Na, connection configuration is switched from wye-connection to delta-connection, whereby torque deficiency in high engine speed N region can be avoided, so that engine speed N can be easily increased to a speed capable of achieving complete combustion.

(2) The engine-generator 100 additionally comprises the power supply circuit 40 including the contactor 42 etc. for starting and cutting off power supply to the generator unit 2 from the battery 5 (FIG. 2). When engine speed N detected by the crankangle sensor 46 reaches or exceeds predetermined engine speed (second speed) Nb higher than the aforesaid predetermined speed (first speed) Na, the control unit 33 outputs a control signal to the contactor drive circuit 44 to cut off supply of power from the battery 5 to the generator unit 2 (S6). As a result, supply of power from the battery 5 can be appropriately cut off after the engine 1 starts.

(3) In this case, predetermined speed Na corresponds to engine speed when or after the engine 1 completes first compression stroke, and predetermined engine speed Nb corresponds to engine speed when the engine 1 can achieve complete combustion. Since this arrangement enables generation of high torque in low speed region of the engine 1 while minimizing torque decline in high speed region of the engine 1, the engine 1 can be easily started without using a high-voltage battery 5.

The foresaid embodiment is adapted to switch connection configuration of the winding 24 to one or the other of wye-connection and delta-connection by ON-OFF controlling the switches 251 to 256 of the switching circuit 25, but a connection switching unit and the connection switching controller are not limited to the aforesaid arrangement. Namely, the configuration of the switching circuit 25 serving as the connection switching unit and the processing performed by the control unit 33 serving to control connection switching can be of any arrangement insofar as at the time of engine starting they switch connection configuration to wye-connection until engine speed N detected by the crankangle sensor 46 reaches predetermined speed Na and switch connection configuration to delta-connection when engine speed N exceeds predetermined speed Na. The foresaid embodiment is adapted to respond to engine speed N exceeding predetermined engine speed Nb by the control unit 33 performing processing to output a control signal that causes the contactor drive circuit 44 to cut off supply of power from the battery 5 to the generator unit 2, but a power supply control unit is not limited to the aforesaid configuration. Alternatively, a charging circuit can be interposed between the battery 5 and the generator unit 2 and the battery 5 can be charged by power from the generator unit 2.

The above embodiment can be combined as desired with one or more of the above modifications. The modifications can also be combined with one another.

Since the present invention enables development of high torque exceeding piston first stroke breakaway torque by power from a battery without using costly devices in an associated power converter circuit, it achieves easy engine starting capability at minimal cost increase.

Above, while the present invention has been described with reference to the preferred embodiments thereof, it will be understood, by those skilled in the art, that various changes and modifications may be made thereto without departing from the scope of the appended claims.

What is claimed is:

1. An engine generator, comprising:

an engine having a piston configured to reciprocate inside a cylinder;

a generator unit having a three-phase winding and configured to be driven by the engine to generate electric power and configured to be able to operate as an engine starter motor during engine starting;

a power converter circuit electrically connected to the generator unit;

a start switch configured to instruct a start of the engine;

a battery configured to supply electric power to the generator unit through the power converter circuit so as to start a cranking rotating a crank shaft of the engine when the start of the engine is instructed by the start switch and the engine starter motor begins turning;

an engine speed detection unit configured to detect an engine speed of the engine;

a connection switching unit configured to switch a connection configuration of the winding to one of a wye-connection and a delta-connection; and a connection switching control unit configured to control the connection switching unit to switch the connection configuration to the wye-connection when the start of the engine is instructed by the start switch, and to switch the connection configuration to the delta-connection when the engine speed detected by the engine speed detection unit becomes equal to or higher than a predetermined engine speed by the cranking before the cranking is completed.

2. The engine generator according to claim 1, further comprising:

a power supply control unit configured to start and cut off electric power supplied by the battery to the generator unit, wherein the predetermined engine speed is a first engine speed corresponding to an engine speed when the engine completes a first compression stroke after the cranking is started, the power supply control unit further configured to cut off electric power supplied by the battery to the generator unit so as to stop the cranking when the engine speed detected by the engine speed detection unit during the cranking is equal to or higher than a second engine speed set higher than the first engine speed.

3. The engine generator according to claim 2, wherein the second engine speed corresponds to an engine speed when the engine can achieve complete combustion.

4. The engine generator according to claim 2, further comprising:

a power supply circuit configured to connect the battery and the generator unit through an on-off switch, wherein the power supply control unit further configured to open the on-off switch to disconnect the power supply circuit when the engine speed detected by the engine speed detection unit is equal to or higher than the second engine speed.

5. The engine generator according to claim 1, wherein the power converter circuit further configured to convert direct current electric power supplied by the battery during engine starting to alternating current electric power, and the connection switching unit is constituted by a switching circuit provided in the power converter circuit.

6. The engine generator according to claim 5, wherein the three-phase winding has a first winding, a second winding and a third winding, one end of each of the first winding, the second winding and the third winding being connected to the power converter circuit through each of a first terminal, a second terminal and a third terminal, other end of each of the first winding, the second winding and the third winding being connected to the switching circuit through each of a fourth terminal, a fifth terminal and a sixth terminal, and the switching circuit has a first switch, a second switch, a third switch, a fourth switch, a fifth switch, and a sixth switch, one end of the first switch being connected to the fourth terminal, other end of the first switch being connected to the second terminal, one end of the second switch being connected to the fifth terminal, other end of the second switch being connected to the third terminal, one end of the third switch being connected to the sixth terminal, other end of the third switch being connected to the first terminal, one end of each of the fourth switch, the fifth switch and the sixth switch being connected to each of the fourth terminal, the fifth terminal and the sixth terminal, other end of each of the fourth switch, the fifth switch and the sixth switch being connected to each other through a neutral point.

7. An engine generator, comprising:

an engine having a piston configured to reciprocate inside a cylinder;

a generator unit having a three-phase winding and configured to be driven by the engine to generate electric power and configured to be able to operate as an engine starter motor during engine starting;

a power converter circuit electrically connected to the generator unit;

a start switch configured to instruct a start of the engine;

a battery configured to supply electric power to the generator unit through the power converter circuit so as to start a cranking rotating a crank shaft of the engine when the start of the engine is instructed by the start switch and the engine starter motor begins turning;

an engine speed detection unit configured to detect an engine speed of the engine;

a connection switching unit configured to switch a connection configuration of the winding to one of a wye-connection and a delta-connection; and a CPU and a memory coupled to the CPU, wherein the CPU and the memory are configured to perform controlling the connection switching unit to switch the connection configuration to the wye-connection when the start of the engine is instructed by the start switch, and to switch the connection configuration to the delta-connection when the engine speed detected by the engine speed detection unit becomes equal to or higher than a predetermined engine speed by the cranking before the cranking is completed.

* * * * *